US005925249A

United States Patent [19]

Fredriksson

[11] Patent Number: 5,925,249

[45] Date of Patent: Jul. 20, 1999

[54] SCREENING ARRANGEMENT

[75] Inventor: Börje Fredriksson, Sundsbruk, Sweden

[73] Assignee: Sunds Defibrator Industries AB, Sweden

[21] Appl. No.: 09/051,337

[22] PCT Filed: Sep. 26, 1996

[86] PCT No.: PCT/SE96/01204

§ 371 Date: Apr. 7, 1998

§ 102(e) Date: Apr. 7, 1998

[87] PCT Pub. No.: WO97/13919

PCT Pub. Date: Apr. 17, 1997

[30] Foreign Application Priority Data

Oct. 11, 1995 [SE] Sweden ..... 9503553

[51] Int. Cl.[6] ..... B07B 1/20; D21D 5/02; D21D 5/16

[52] U.S. Cl. ..... 210/415; 210/414; 210/304; 210/308; 162/55; 162/251; 209/17; 209/273; 209/250; 209/306

[58] Field of Search ..... 210/415, 414, 210/304, 308, 319; 162/55, 251; 209/273, 250, 306, 17

[56] References Cited

U.S. PATENT DOCUMENTS 3,726,401 4/1973 Bolton, III et al. .
3,912,622 10/1975 Bolton, III et al. .
4,165,841 8/1979 Musselmann et al. .
5,492,225 2/1996 Musselmann et al. .
5,622,267 4/1997 Hautala .

FOREIGN PATENT DOCUMENTS

0142054 A2 5/1985 European Pat. Off. .

*Primary Examiner*—Thomas M. Lithgow
*Attorney, Agent, or Firm*—Lerner, David, Littenberg, Krumholz & Mentlik, LLP

[57] ABSTRACT

Apparatus for screening pulp suspensions containing heavy impurities is disclosed including a casing with an inlet for the pulp suspension at the lower end of the casing, a stationary screen mounted within the casing, a rotor mounted for rotation within the stationary screen thus forming a screening zone between the rotor and the stationary screen, with the inlet disposed within the rotor, the rotor including at least one opening adjacent to its upper end for transferring the pulp into the screening zone and a chamber for the heavy impurities disposed adjacent to either the upper or lower end of the casing, the rotor including strips or grooves for moving heavy impurities from the inner surface of the rotor to the chamber.

16 Claims, 2 Drawing Sheets

SCREENING ARRANGEMENT

FIELD OF THE INVENTION

The present invention relates to an arrangement for screening pulp suspensions in order to separate impurities and other pulp fractions, which are not desired to be included in the final product, such as coarse particles, undefibered material and poorly worked fibers.

BACKGROUND OF THE INVENTION

During the manufacture of fiber suspensions, undesired coarse particles, such as, for example, undefibered material, bark, knots and the like, are present in the suspension as a result of incomplete manufacturing processes. In addition, other impurities, which are both light and heavy, such as plastics, sand and scrap, can also be found in the suspension. In particular, fiber suspensions of slushed return fibers contain great amounts of foreign impurities. Heavy impurities, such as stones, sand and glass, plaster and wire clips, and light impurities, such as certain plastics, agglomerated glue lumps ("stickies") etc., can cause interruptions in the screening process. It is, therefore, desired to separate them at an early stage of the screening process. For this purpose, special devices, for example knot screens or refiners, can be arranged before the screen in order to eliminate the coarse impurities or reduce their size. Light impurities can also be separated by special devices before the screen. It is also possible to separate the coarse impurities by a first screening step in the screening arrangement or to separate scrap and heavy particles when the suspension enters the screen, and other impurities during the fine screening process. In the last mentioned case, the screening process can be disturbed by the impurities, as mentioned above.

During the screening of pulp suspensions it is also desired to have a high pulp concentration, for example, about 3 to 5%, and a low reject draw-off in order to achieve a high production capacity and to avoid unnecessarily large liquid transport in the screening system. High concentration and low reject draw-off, however, imply greater difficulties in separating the impurities from the pulp.

SUMMARY OF THE INVENTION

According to the present invention, the aforesaid problems are solved for designing the screening arrangement for screening the pulp suspension in two integrated steps, where heavy and light impurities can be separated in a first step, and fine screening takes place in a second step.

In accordance with the present invention, these objects have thus been achieved by the discovery of apparatus for screening pulp suspensions containing heavy impurities comprising a casing including a lower end and an upper end and including an inlet for the pulp suspension disposed at the lower end of the casing, a stationary screen mounted within the casing, a rotor mounted for rotation within the stationary screen, the rotor including an inner surface, a lower end and an upper end and forming a screening zone between the rotor and stationary screen, the inlet being disposed within the rotor, the rotor including at least one opening adjacent to the upper end of the casing for transferring the pulp into the screening zone, and a chamber for the heavy impurities disposed adjacent to one of the upper and lower ends of the casing, the rotor including heavy impurity movement means for moving the heavy impurities from the inner surface of the rotor to the chamber.

In accordance with one embodiment of the apparatus of the present invention, the chamber for the heavy impurities is disposed at the lower end of the casing adjacent to the lower end of the rotor.

In accordance with another embodiment of the apparatus of the present invention, the chamber for the heavy impurities is disposed at the upper end of the casing adjacent to the upper end of the rotor.

In accordance with another embodiment of the apparatus of the present invention, the rotor includes a cylindrical surface including strips for guiding the heavy impurities upwardly within the rotor. In a preferred embodiment, the strips are axially disposed along the inner surface of the rotor. In another embodiment the strips are disposed at a predetermined angle with respect to the axial direction of the rotor.

In accordance with another embodiment of the apparatus of the present invention, the rotor is cylindrical and the cylindrical inner surface of the rotor includes grooves for guiding the heavy impurities upwardly within the inner surface of the rotor. In another embodiment, the grooves are axially disposed along the inner surface of the rotor. In yet another embodiment, the grooves are disposed at a predetermined angle with respect to the axial direction of the rotor along the inner surface of the rotor.

In accordance with another embodiment of the apparatus of the present invention, the strips extend in the form of a screw about the inner surface of the rotor. In a preferred embodiment, the grooves extend in the form of a screw along the inner surface of the rotor.

In accordance with another embodiment of the apparatus of the present invention, the rotor is conical and the conical inner surface of the rotor includes an inner diameter which increases in the downward direction.

In accordance with another embodiment of the apparatus of the present invention, the inlet is tangentially disposed with respect to the rotor.

In accordance with another embodiment of the apparatus of the present invention, the apparatus includes a stationary housing disposed within the rotor, the stationary housing including a rotationally symmetrical wall axially spaced from the inner surface of the rotor. In one embodiment, the apparatus includes strips disposed on the rotationally symmetrical wall of the stationary housing for discharging light impurities therealong. In another embodiment, the apparatus includes grooves disposed along the rotationally symmetrical wall of the stationary housing for discharging light impurities therealong.

BRIEF DESCRIPTION OF THE DRAWINGS

The present invention may be more fully understood with reference to the following detailed description, which in turn refers to the Figures in which.

DETAILED DESCRIPTION

Figure 1:
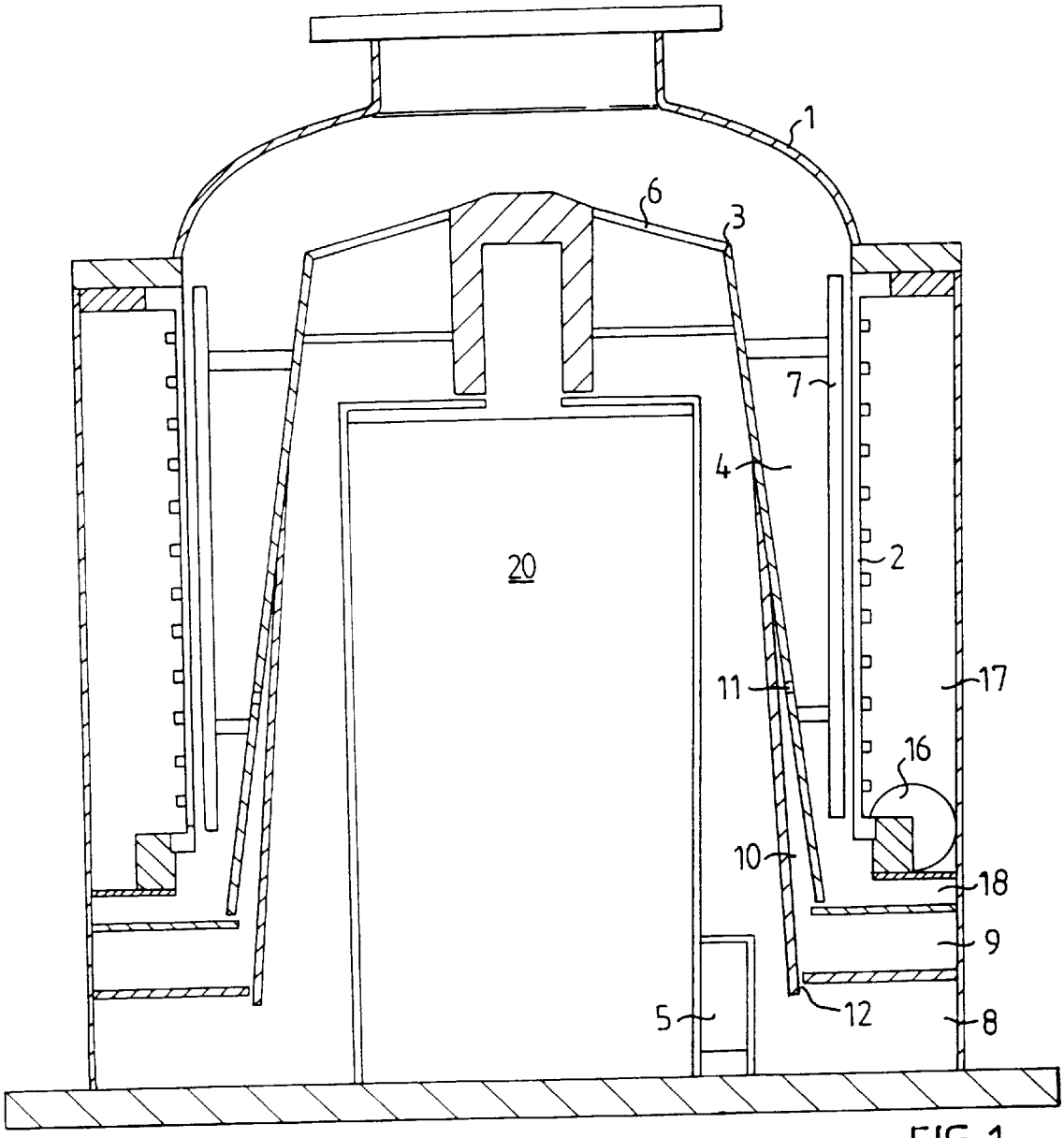
FIG. 1 is a side, elevational, sectional view of the screening apparatus of the present invention.
Figure 2:
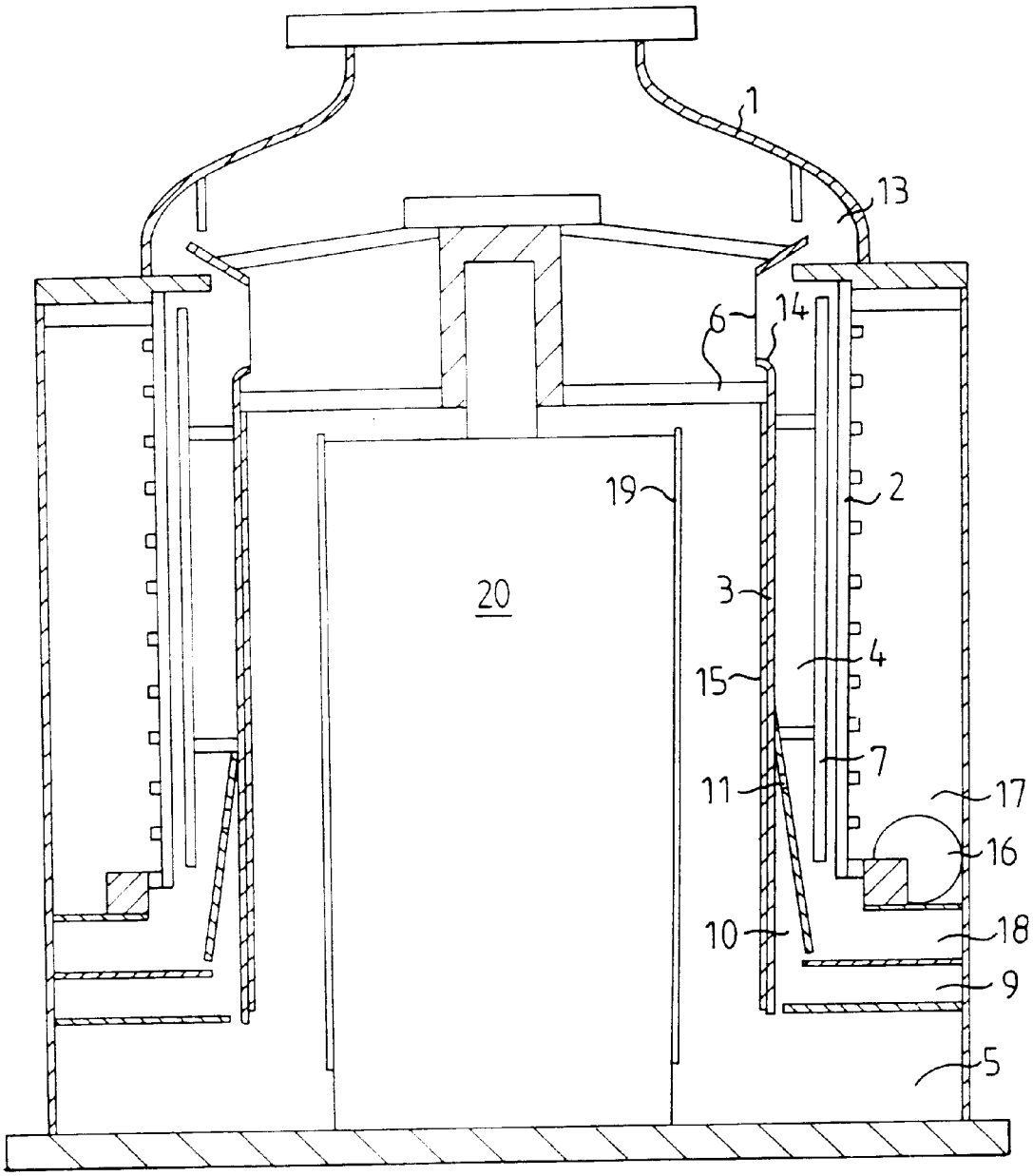
FIG. 2 is a side, elevational, sectional view of another embodiment of the screening apparatus of the present invention.

The screening apparatus according to FIGS. 1 and 2 comprises an airtight casing 1 with a stationary, preferably cylindrical screening member 2 with a vertically symmetrical axis. Within the screening member 2, a drum-shaped rotor 3 is located, which extends along the entire screening member. The rotor 3 is concentric with the screening member 2, so that an overall screening zone 4 is formed between the rotor and the screening member. The rotor 3 is supported by a stationary housing 20, which is located within the rotor and has a rotationally symmetrical wall extending axially spaced from the inside of the rotor. This wall can be cylindrical or conical.

An inject inlet 5 for the pulp is connected to the casing 1 for the supply of pulp from below to the lower portion of the inside of the rotor 3. The inlet 5 is preferably located tangentially, so that the inject is supplied in the direction of rotation of the rotor 3.

The rotor 3 is designed as a drum, through which the pulp suspension is intended to flow upward and through one or several openings 6 in the upper portion of the rotor 3 for transferring the pulp to the upper end of the screening zone 4. The rotor 3 is provided on its outside with pulsation generating means 7 extending into the screening zone 4.

In the embodiment shown in FIG. 1, the inside of the rotor is formed for moving heavy impurities downwardly to a chamber 8 in the lower portion of the rotor 3, and the lower edge of the rotor 3 extends downwardly into the chamber 8. In order to bring about this separation, the inside of the rotor can be conical, with the greatest diameter at its lower end. The inner surface can be smooth, or it can possibly be provided with strips or grooves extending axially or angularly with respect to the axial direction. This angle can be small, or such that the strips extend in the form of a screw about the rotor. When strips or grooves are used, the angle of the cone can be smaller. It is also possible to form the inside of the rotor cylindrical. The stationary wall of the housing 20 can be formed in a corresponding manner for an upward discharge of light impurities.

In both embodiments shown an inlet 9 for dilution liquid is connected to the casing 1 of the screening arrangement. This inlet communicates with a space 10 in the rotor 3, which space is formed with openings 11 in the rotor for the supply of dilution liquid to the screening zone 4, preferably in the lower portion of the screening zone.

In the embodiment shown in FIG. 1, between the inlet 9 for dilution liquid and the chamber 8, a passage 12 is located, through which a restricted amount of dilution liquid can pass. This passage 12 is preferably provided between the lower edge of the rotor 3 and the upper defining wall of the chamber 8.

The chamber 8 can be designed for discontinuous or continuous emptying, depending on the expected content of heavy impurities in the pulp.

In the embodiment shown in FIG. 1, pulp to be screened is supplied through the inlet 5 to the inside of rotor 3. At the same time as the pulp is rotated by the rotor, it flows upwardly through the rotor to the openings 6 at the top of the rotor. Owing to the effect of centrifugal force, heavy impurities are collected adjacent the inner surface of the rotor. Due to the rotor design, these impurities are guided downwardly to the chamber 8, from where they can be removed in a suitable manner, as mentioned above. In this way, separation of heavy impurities is achieved in a first step.

In the embodiment shown in FIG. 2, the inside of the rotor 3 preferably is cylindrical and can possibly be provided with strips 15 on grooves axial with or at a small angle to the axial direction, so that the heavy impurities are guided with the pulp flow upwardly along the inside of the rotor 3 to be discharged to a chamber 13 intended for this purpose at the upper edge of the rotor 3. According to this embodiment, the openings 6 in the upper portion of the rotor 3 for transferring the pulp to the upper end of the screening zone 4 are formed with an edge 14 extending a distance inwardly from the inside of the rotor 3. In this manner, the coarse and heavy impurities are prevented from moving upwardly along the inside of the rotor to follow along with the pulp through the openings 6. These impurities, instead, are guided past the openings 6 to the chamber 13, from which they can be taken out discontinuously or continuously, depending on the expected content of impurities in the pulp.

At the same time as heavy impurities are concentrated at the inner surface of the rotor 3, light impurities are concentrated at the wall surface of the housing 20. These light impurities are guided upwardly and accumulate centrally upwardly in the rotor 3, from where they can be discharged. The light impurities, for example, can be guided upwardly through the rotor top and be discharged centrally form the upper portion of the casing 1. For this purpose, the wall of the housing 20 can be formed with strips or grooves in order to promote separation of the light impurities. The separation of heavy and, respectively, light impurities, thus, takes place before the pulp enters the screening zone 4.

The pulp flow flowing through the openings 6 at the top of the rotor 3 continues downwardly in the screening zone 4 for fine screening in a second step whereby the pulp is divided into accept and reject portions. This dividing of the pulp into accept and reject portions, is promoted by the pulsation generating means 7, which brings about pressure and speed variations in the pulp suspension which are favorable for the screening. Due to the accept portions passing through the screening member together with a portion of the liquid, the liquid content in the reject transported along the screening zone 4 decreases. This thickening of the reject is counteracted by the supply of dilution liquid through the openings 11 in the rotor 3 at the end of the screening zone. The supply of dilution liquid is preferably controlled so that he outgoing reject has the desired concentration.

For removing the accept portion, an accept outlet 16 is connected to a space 17 in the casing 1, which space is located outside the screening member 2. A reject outlet 18 is connected to the casing 1 for discharging the reject portion after the screening zone 4.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. Apparatus for screening pulp suspensions containing heavy impurities comprising a casing including a lower end and an upper end and including an inlet for said pulp suspension disposed at said lower end of said casing, a stationary screen mounted within said casing, a rotor mounted for rotation within said stationary screen, said rotor including an inner surface, a lower end and an upper end and forming a screening zone between said rotor and said stationary screen, said inlet being disposed within said rotor, said rotor including at least one opening adjacent to said upper end of said casing for transferring said pulp into said screening zone, and a chamber for said heavy impurities disposed adjacent to one of said upper and lower ends of said casing, said rotor including heavy impurity movement means for moving said heavy impurities from said inner surface of said rotor to said chamber.

2. The apparatus of claim 1 wherein said chamber for said heavy impurities is disposed at said lower end of said casing adjacent to said lower end of said rotor.

3. The apparatus of claim 1 wherein said chamber for said heavy impurities is disposed at said upper end of said casing adjacent to said upper end of said rotor.

4. The apparatus of claim 1 wherein said rotor includes a cylindrical surface including strips for guiding said heavy impurities upwardly within said rotor.

5. The apparatus of claim 4 wherein said strips are axially disposed along said inner surface of said rotor.

6. The apparatus of claim 4 wherein said strips are disposed at a predetermined angle with respect to said axial direction of said rotor.

7. The apparatus of claim 1 wherein said rotor is cylindrical and said cylindrical inner surface of said rotor includes grooves for guiding said heavy impurities upwardly within said inner surface of said rotor.

8. The apparatus of claim 7 wherein said grooves are axially disposed along said inner surface of said rotor.

9. The apparatus of claim 7 wherein said grooves are disposed at a predetermined angle with respect to the axial direction of said rotor along said inner surface of said rotor.

10. The apparatus of claim 4 wherein said strips extend in the form of a screw about said inner surface of said rotor.

11. The apparatus of claim 7 wherein said grooves extend in the form of a screw along said inner surface of said rotor.

12. The apparatus of claim 1 wherein said rotor is conical and said conical inner surface of said rotor includes an inner diameter which increases in the downward direction.

13. The apparatus of claim 1 wherein said inlet is tangentially disposed with respect to said rotor.

14. The apparatus of claim 1 including a stationary housing disposed within said rotor, said stationary housing including a rotationally symmetrical wall axially spaced from said inner surface of said rotor.

15. The apparatus of claim 14 including strips disposed on said rotationally symmetrical wall of said stationary housing for discharging light impurities therealong.

16. The apparatus of claim 14 including grooves disposed along said rotationally symmetrical wall of said stationary housing for discharging light impurities therealong.

* * * * *